US010133221B2

(12) United States Patent
Uchida et al.

(10) Patent No.: US 10,133,221 B2
(45) **Date of Patent: *Nov. 20, 2018**

(54) IMAGE FORMING APPARATUS

(71) Applicant: FUJI XEROX CO., LTD., Tokyo (JP)

(72) Inventors: Masahiro Uchida, Kanagawa (JP); Masataka Kuribayashi, Kanagawa (JP); Takafumi Koide, Kanagawa (JP); Yusuke Fukuda, Kanagawa (JP); Katsuyuki Kitajima, Kanagawa (JP); Satomi Hara, Kanagawa (JP); Kana Yoshida, Kanagawa (JP); Koji Funaba, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/895,200

(22) Filed: Feb. 13, 2018

(65) Prior Publication Data

US 2018/0275575 A1 Sep. 27, 2018

(30) Foreign Application Priority Data

Mar. 24, 2017 (JP) ..... 2017-059534

(51) Int. Cl.

| | |
|---|---|
| ***G03G 15/20*** | (2006.01) |
| ***G03G 9/087*** | (2006.01) |
| ***G03G 9/08*** | (2006.01) |

(52) U.S. Cl.

CPC ..... *G03G 15/2089* (2013.01); *G03G 9/0819* (2013.01); *G03G 9/0827* (2013.01); *G03G 9/08711* (2013.01); *G03G 9/08755* (2013.01); *G03G 9/08784* (2013.01); *G03G 15/20* (2013.01); *G03G 15/2053* (2013.01); *G03G 2215/2019* (2013.01); *G03G 2215/2025* (2013.01); *G03G 2215/2032* (2013.01)

(58) Field of Classification Search

CPC ..... G03G 15/20; G03G 2215/2019; G03G 2215/2025

See application file for complete search history.

(56) References Cited

U.S. PATENT DOCUMENTS

| | | | | |
|---|---|---|---|---|
| 6,013,406 A * | 1/2000 | Moriki | G03G 9/0821 | 430/108.22 |
| 2014/0255839 A1* | 9/2014 | Taguchi | G03G 9/09733 | 430/105 |
| 2015/0168884 A1* | 6/2015 | Kakishima | G03G 15/2039 | 399/67 |

FOREIGN PATENT DOCUMENTS

JP 2014-056126 A 3/2014

* cited by examiner

*Primary Examiner* — Ryan D Walsh
(74) *Attorney, Agent, or Firm* — Sughrue Mion, PLLC

(57) ABSTRACT

An image forming apparatus includes a fixing unit including a fixing belt, a pressurizing rotator that forms a nip portion between the fixing belt and the pressurizing rotator by pressurizing an outer peripheral surface of the fixing belt, a first heating rotator that is provided so as to contact an inner peripheral surface of the fixing belt in the nip portion and heats the fixing belt, and a second heating unit that heats the fixing belt separately from the first heating rotator, wherein a toner to be used has physical properties described in the specification and includes an amorphous resin, a crystalline resin, and paraffin wax having a melting temperature of 60° C. to 80° C., and an absolute value of a difference in a melting temperature between the crystalline resin and the paraffin wax is 10° C. or less.

10 Claims, 2 Drawing Sheets

IMAGE FORMING APPARATUS

CROSS-REFERENCE TO RELATED APPLICATIONS

This application is based on and claims priority under 35 USC 119 from Japanese Patent Application No. 2017-059534 filed Mar. 24, 2017.

BACKGROUND

1. Technical Field

The present invention relates to an image forming apparatus.

2. Related Art

Image forming by using an electrophotographic method is performed in such a manner that a surface of a photoreceptor is charged entirely, then the surface of the photoreceptor is exposed to a laser beam in accordance with image information to form an electrostatic charge image, subsequently, the electrostatic charge image is developed with a developer containing toner to form a toner image, and lastly the toner image is transferred and fixed to a surface of a recording medium.

SUMMARY

According to an aspect of the invention, there is provided an image forming apparatus including:

an image holding member;

a charging unit that charges a surface of the image holding member;

an electrostatic charge image forming unit that forms an electrostatic charge image on a charged surface of the image holding member;

a developing unit that includes an electrostatic charge image developer containing an electrostatic charge image developing toner, and develops the electrostatic charge image on the surface of the image holding member to thereby form a toner image;

a transfer unit that transfers the toner image to a recording medium; and a fixing unit that fixes the toner image on the recording medium, wherein the fixing unit includes:

a fixing belt, a pressurizing rotator that forms a nip portion between the fixing belt and the pressurizing rotator by pressurizing an outer peripheral surface of the fixing belt, a first heating rotator that is provided so as to contact an inner peripheral surface of the fixing belt in the nip portion and heats the fixing belt, and a second heating unit that is provided on at least one of an inner peripheral surface side and an outer peripheral surface side of the fixing belt, and heats the fixing belt separately from the first heating rotator, and wherein the electrostatic charge image developing toner includes:

a binder resin containing an amorphous resin and a crystalline resin; and paraffin wax, wherein the toner has a volume average particle diameter of 6 μm to 9 μm, a shape factor SF1 of 140 or more, and a toluene-insoluble portion of 25% by weight to 45% by weight;

the paraffin wax has a melting temperature of 60° C. to 80° C.; and an absolute value of a difference between a melting temperature of the crystalline resin and a melting temperature of the paraffin wax is 10° C. or less.

BRIEF DESCRIPTION OF THE DRAWINGS

Exemplary embodiments of the present invention will be described in detail based on the following figures, wherein.

DETAILED DESCRIPTION

Figure 1:
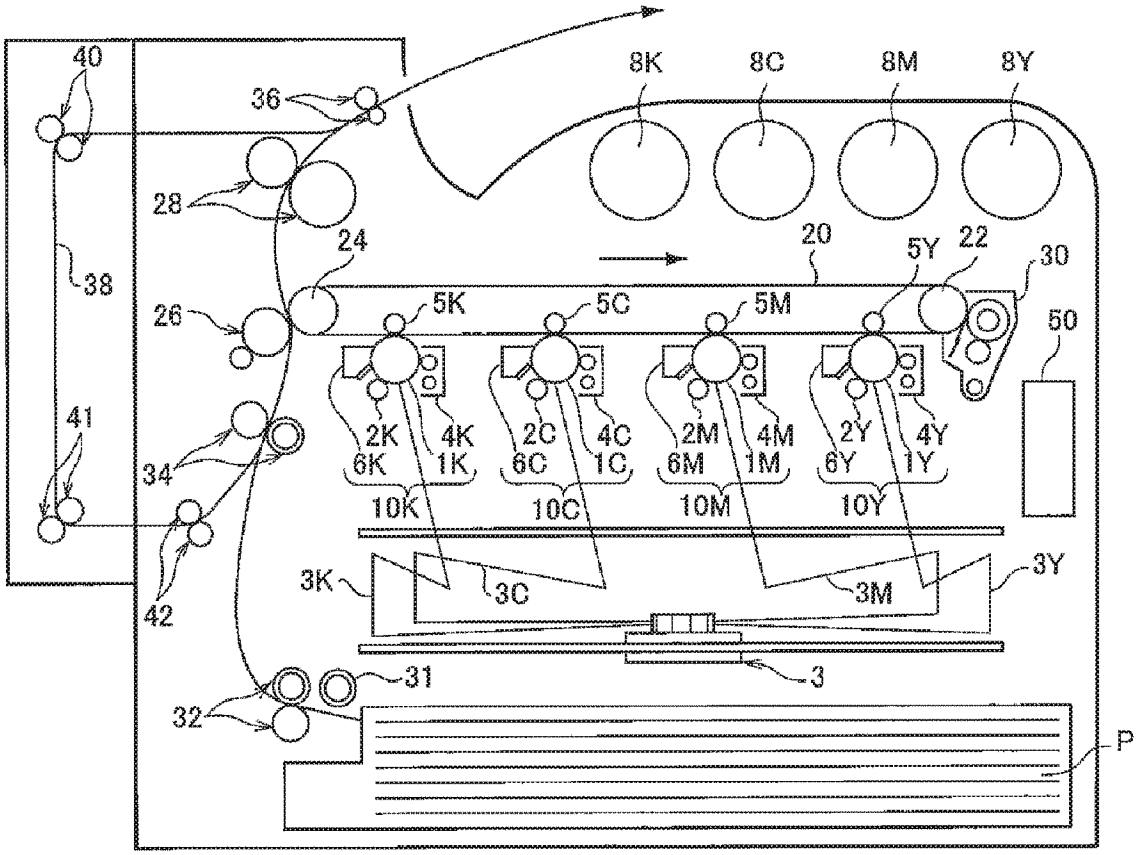
FIG. 1 is a schematic configuration diagram illustrating an example of an image forming apparatus according to the exemplary embodiment.

Hereinafter, the exemplary embodiment which is an example of the invention will be described in detail.

Image Forming Apparatus

An image forming apparatus according to the exemplary embodiment is provided with an image holding member, a charging unit that charges a surface of the image holding member, an electrostatic charge image forming unit that forms an electrostatic charge image on the charged surface of the image holding member, a developing unit that accommodates an electrostatic charge image developer including an electrostatic charge image developing toner (hereinafter, also simply referred to as "toner"), and develops the electrostatic charge image formed on the surface of the image holding member as a toner image with the electrostatic charge image developer, a transfer unit that transfers the toner image formed on the surface of the image holding member to a surface of a recording medium, and a fixing unit that fixes the toner image onto the surface of the recording medium, and includes a fixing belt, a pressurizing rotator that forms a nip portion between the fixing belt and the pressurizing rotator by pressurizing an outer peripheral surface of the fixing belt, a first heating rotator that is provided so as to contact an inner peripheral surface of the fixing belt in the nip portion and heats the fixing belt, and a second heating unit that is provided on at least one of the inner peripheral surface side and the outer peripheral surface side of the fixing belt, and heats the fixing belt separately from the first heating rotator.

The toner includes toner particles containing a binder resin which contains an amorphous resin and a crystalline resin, and paraffin wax having a melting temperature in a range from 60° C. to 80° C., and in the toner, the absolute value in a difference between the melting temperature of the crystalline resin and the melting temperature of the paraffin wax is equal to or lower than 10° C., the volume average particle diameter of the toner particles is from 6 μm to 9 μm, a shape factor SF1 of the toner particles is equal to or greater than 140, and a toluene-insoluble portion of the toner is from 25% by weight to 45% by weight.

In the toner, the case where the toluene-insoluble portion is from 25% by weight to 45% by weight means that the toner contains an appropriate content of a crosslinked resin. That is, the toluene-insoluble portion means an index of the content of the crosslinked resin contained in the toner.

In addition, in the toner particles, the case where the shape factor SF1 is equal to or greater than 140 means that the shape of the toner particle is irregular. Note that, the irregular toner particles having the shape factor SF1 of equal to or greater than 140 typically mean pulverized toner particles prepared by using a pulverization method (for example, a kneading and pulverizing method).

In addition, in the toner particles, the case where the volume average particle diameter is from 6 μm to 9 μm means that the toner particles have a relatively small diameter.

Hereinafter, the toner having the above-described features in the exemplary embodiment may be referred to as a "specific pulverized toner".

In the related art, in the electrophotographic image forming apparatus, in order to achieve, for example, low temperature fixability, a toner containing a crystalline resin as a binder resin, and paraffin wax having a melting temperature in a range from 60° C. to 80° C. as wax may be used. In addition, pulverized toner particles obtained by using a pulverization method such as a kneading and pulverizing method as a method of preparing such a toner are widely used. Since the pulverized toner particles are generally prepared by mixing the binder resin, the coloring agent, wax, and the like with each other, and then pulverizing the mixture, the shape of the toner particles are likely to be irregular, and the crystalline resin and wax (that is, a release agent) are likely to be exposed on the surface. Here, the toner particles are prepared by using a pulverizing method, and thus degree of exposure (the ratio of the exposed area on the particle surface) of the crystalline resin and the wax for each individual pulverized toner particle tends to vary. The crystalline resin and wax are relatively easy to melt as compared with other components in the pulverized toner particles; however, the degrees of the exposure of the crystalline resin and wax which are likely to be melted are different for each pulverized toner particle, and thus when heat is applied so as to perform the fixing, a melting manner is likely to be different for each pulverized toner particle. That is, variation in melting between toners is likely to occur. As a result, toner particles which are likely to be melted and firmly fixed, and toner particles which are less likely to be melted and thus hard to enhance the fixing level are present together in the toner image, and thereby the fixability of the entire toner images is likely to be deteriorated.

Here, when the heating is performed in the fixing unit, if the heating with the sufficiently high total heating amount is performed to the extent that the pulverized toner particles having the relatively low degree of exposure of the exposure of the crystalline resin and the wax may be also melted, the fixability may be enhanced. However, in a case where the fixing belt which is provided with a heating rotator contacting the inner peripheral surface side in the nip portion is applied as the fixing unit, the fixability is deteriorated while the image formation is continuously repeated.

The reason for that is presumed as follows. In a case of using the fixing unit which is provided with, as a heating unit that heats the fixing belt, only a heating rotator disposed so as to contact the inner peripheral surface of the nip portion, continuously repeating the image formation means that heat absorption by the toner image is intermittently repeated on the outer peripheral surface side of the fixing belt. For this reason, the temperature of the fixing belt itself is slowly decreased, and the total heat amount given to toner image also is slowly decreased while the image formation is continuously repeated, that is, while the image formation is continuously repeated without stopping a fixing operation of the toner image. As a result, it is considered that in the toner image formed by the pulverized toner particles having melting variation between toners, the fixability is likely to be deteriorated due to the continuous image formation.

Note that, the deterioration of the fixability is more namely to occur as the transport speed (hereinafter, also referred to as "process speed") of the recording medium at the nip portion becomes faster.

The reason for this is that the time for the toner image to pass through the nip portion becomes shortened as the process speed is high (for example, from 350 mm/s to 380 mm/s), as a result, the total heat amount given to the toner image from the fixing belt is less likely to be increased, and the temperature of the fixing belt, which is decreased due to the fixing, is not be sufficiently recovered to the fixing set temperature (the temperature of the fixing belt at the time of the fixing) before the next fixing is performed. Accordingly, when the pulverized toner particles are applied to an image forming apparatus having a high process speed, the fixability is more likely to be deteriorated.

In contrast, in the image forming apparatus according to the exemplary embodiment, the fixing unit has a configuration in which a first heating rotator is provided on the inner peripheral surface side of the fixing belt in the nip portion, and separately from the first heating rotator, one or more second heating units are provided on at least one of the inner peripheral surface side and the outer peripheral surface side of the fixing belt. That is, in the image forming apparatus according to the exemplary embodiment, the fixing belt is heated from the nip portion and one or more points other than the nip portion. With this, it is possible to obtain the excellent fixability even with the pulverized toner particles in which the melting variation between the toners tends to occur.

Although the reason is not clear, it is presumed that it is due to the following reason.

Figure 2:
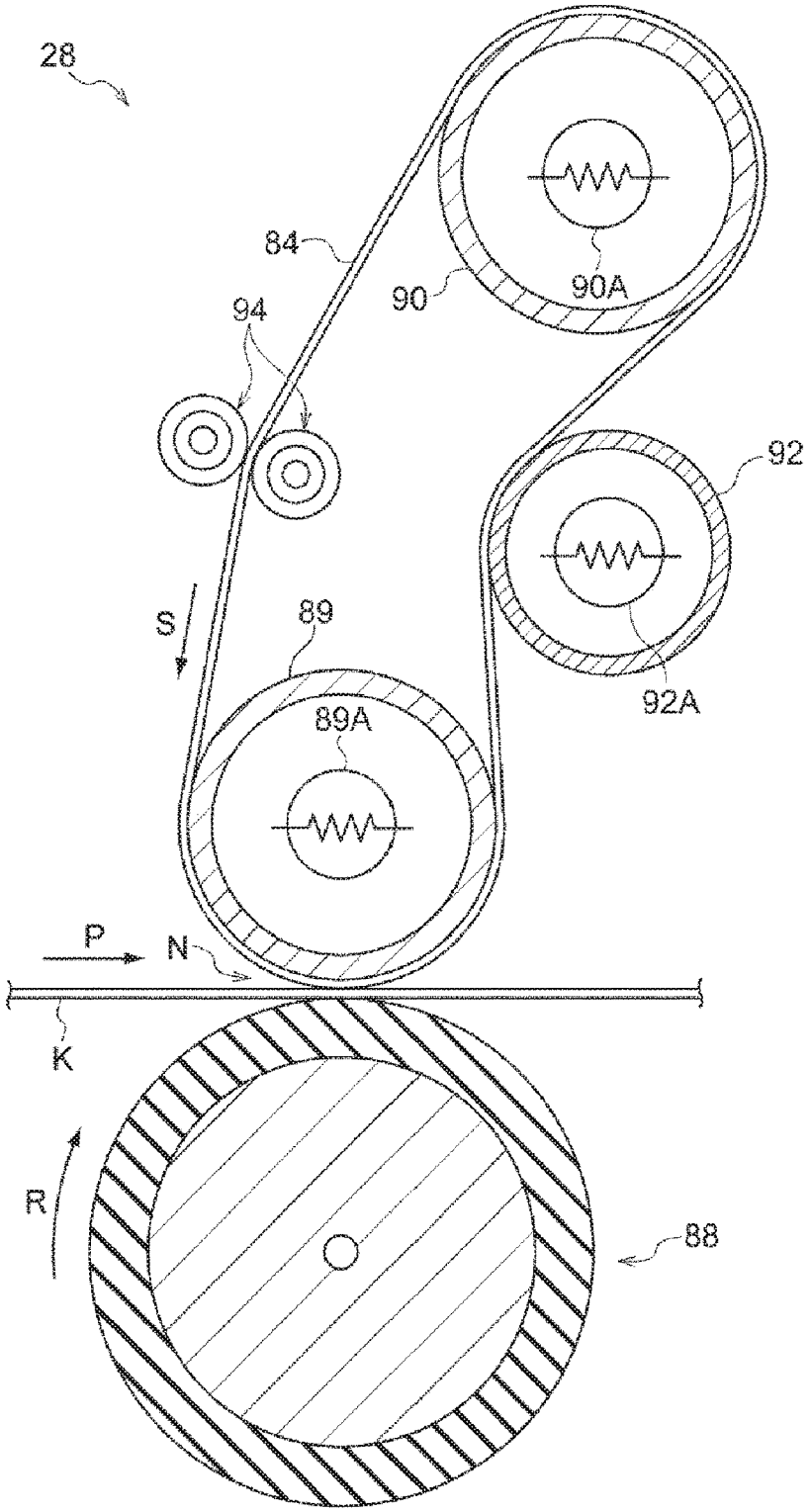
FIG. 2 is a schematic configuration diagram illustrating an example of a fixing device provided in the image forming apparatus of the exemplary embodiment.

FIG. 2 is a schematic configuration diagram indicating an example of a fixing device provided in the image forming apparatus of the exemplary embodiment.

As illustrated in FIG. 2, a fixing device 28 is provided with a fixing belt 84, a pressurizing roller 88 (an example of the pressurizing rotator) that forms a nip portion N with the fixing belt 84, a first heating roller 89 (an example of the first heating rotator) that is provided on the inner peripheral surface of the fixing belt 84 in the nip portion N, a second heating roller 90 (an example of the second heating unit) that is provided the inner peripheral surface side of the fixing belt 84 in addition to the first heating roller 89, a third heating roller 92 (an example of the second heating unit) that is provided on the outer peripheral surface of the fixing belt 84, and a pair of support rollers 94 that support the fixing belt 84 nipped therebetween. Note that, the first heating roller 89, the second heating roller 90, and the third heating roller 92 are respectively provided with halogen heaters 89A, 90A, and 92A therein.

In the fixing device 28 having the above-described configuration, it is considered that the temperature of the fixing belt 84 in which the fixing is finished at the nip portion N is decreased on the downstream side of the nip portion N in the rotation direction of the fixing belt 84 (in FIG. 2, direction S). However, the fixing device 28 is provided with the third heating roller 92 and the second heating roller 90 in order on the downstream side of the nip portion N in addition to the first heating roller 89 that heats the nip portion N, and thus the fixing belt 84 having the decreased temperature is heated by the third heating roller 92 and the second heating roller 90 before the next fixing is performed. With this, the temperature of the fixing belt 84 is likely to be recovered to the fixing set temperature (the temperature of the fixing belt at the time of the fixing), and thus the next fixing is prevented from being performed in a state where the temperature of the fixing belt 84 is not sufficiently recovered. That is, even in the case where the image formation is continuously repeated, the total heat amount given to the toner image is prevented to be decreased.

Further, in the fixing device 28, the heating is performed on the entire belt circumferential direction as compared with the case where the fixing belt 84 is heated by only the first heating roller 89. With this, even when the temperature is decreased every time when the fixing belt 84 passes through the nip portion N, the width of the temperature decrease is small and the recovered temperature of the fixing belt 84 is more likely to be held in a state where the temperature is close to the fixing set temperature. As a result, it is considered that the fixing is stably performed even when the continuous image formation is performed.

As described above, in the image forming apparatus of the exemplary embodiment, in the fixing device 28, the temperature of the fixing belt 84 is more likely to be held in a state where the temperature is close to the fixing set temperature. That is, the temperature of the fixing belt is prevented from being decreased in accordance with the continuous image formation, and thus even when the pulverized toner particles are used, the properties of the pulverized toner particles at the time of the fixing, that is, "proneness of variation in the melting between toners" is less likely to affect the deterioration of the fixability.

Accordingly, according to the image forming apparatus of the exemplary embodiment, even when the pulverized toner particles are used, it is possible to obtain the excellent fixability.

Further, according to the image forming apparatus of the exemplary embodiment, in a case where the transport speed of the recording medium (process speed) is high (for example, from 350 mm/sec to 380 mm/sec), it is likely to obtain the excellent fixability.

In the image forming apparatus of the exemplary embodiment, an area to be heated, in which the fixing belt is heated by at least one heating unit of one or more of the second heating units is preferably provided in an area on the downstream side of the nip portion in the rotation direction of the fixing belt and within 50% of the circumferential length of the fixing belt from the nip portion.

With this, even when the continuous image formation is performed, the total heat amount given to the toner image is further prevented from being decreased, and the fixing is more stably performed. As a result, it is more likely to obtain the excellent fixability.

The area to be heated is preferably provided on the downstream side of the nip portion in the rotation direction of the fixing belt, and in an area within 40% of the circumferential length of the fixing belt from the nip portion, and is further preferably provided in an area within 30% thereof.

Examples of the image forming apparatus according to the exemplary embodiment include known image forming apparatuses such as an apparatus using a direct transferring method of directly transferring a toner image formed on a surface of an image holding member to a recording medium; an apparatus using an intermediate transferring method of primarily transferring the toner image formed on the surface of the image holding member to the surface of the intermediate transfer member, and secondarily transferring the toner image transferred to the surface of the intermediate transfer member to the surface of the recording medium; an apparatus including a cleaning unit that cleans the surface of the image holding member, after transferring the toner image and before being charged; and an apparatus including an erasing unit that erases the charge by irradiating the surface of the image holding member with erasing light after transferring the toner image and before being charged.

In the case of the apparatus using the intermediate transferring method, the transfer unit is configured to include an intermediate transfer member in which a toner image is transferred to the surface thereof, a primary transfer unit that primarily transfers the toner image formed on the surface of the image holding member to the surface of the intermediate transfer member, and a secondary transfer unit that secondarily transfers the toner image transferred to the surface of the intermediate transfer member to the surface of the recording medium.

Hereinafter, an example of the image forming apparatus according to the exemplary embodiment will be described with reference to the drawings. Note that, main parts illustrated in the drawings will be described and other parts will not be described.

FIG. 1 is a schematic configuration diagram illustrating an example of an image forming apparatus according to the exemplary embodiment.

The image forming apparatus as illustrated in FIG. 1 is provided with first to fourth image forming units 10Y, 10M, 10C, and 10K using an electrophotographic method and outputting color images of yellow (Y), magenta (M), cyan (C), and black (K) based on color separated image data. The image forming units (hereinafter, may be simply referred to as "unit") 10Y, 10M, 10C, and 10K are arranged in parallel at a predetermined distance apart from each other in the horizontal direction. Note that, the units 10Y, 10M, 10C, and 10K may be a process cartridge which is detachable from the image forming apparatus.

On the upper side of the respective units 10Y, 10M, 10C, and 10K in FIG. 1, an intermediate transfer member 20 is provided over the respective units. The intermediate transfer member 20 is provided to be wound around a driving roller 22 and a support roller 24 contacting the intermediate transfer member 20, which are disposed apart from each other in the left to right direction in FIG. 1, and travels in the direction from the first unit 10Y to the fourth unit 10K. Note that, a force is applied to the support roller 24 in a direction away from the driving roller 22 by a spring or the like (not shown), and tension is applied to the intermediate transfer member 20 wound around the both. In addition, on the surface on the image holding member side of the intermediate transfer member 20, an intermediate transfer member cleaning device 30 is provided to face the driving roller 22.

In addition, toners including four color toners of yellow, magenta, cyan, and black respectively accommodated in toner cartridges 8Y, 8M, 8C, and 8K are supplied to developing devices 4Y, 4M, 4C, and 4K of the units 10Y, 10M, 10C, and 10K, respectively.

The first to fourth units 10Y, 10M, 10C, and 10K have the same configuration, and thus the first unit 10Y that forms a yellow image disposed on the upstream side in the intermediate transfer member running direction will be representatively described in the exemplary embodiment. Note that, the second to fourth units 10M, 10C, and 10K will not be described by giving reference numerals affixed with magenta (M), cyan (C), and black (K) to the same parts of the first unit 10Y, instead of yellow (Y).

The first unit 10Y includes a photoreceptor 1Y which acts as an image holding member. In the circumference of the photoreceptor 1Y, a charging device 2Y which charges the surface of the photoreceptor 1Y at a predetermined potential, an electrostatic charge image forming device 3 that forms an electrostatic charge image by exposing the charged surface to light 3Y based on a color-separated image signal, a developing device 4Y that develops the electrostatic charge image by supplying a charged toner to the electrostatic charge image, a primary transfer device 5Y that transfers the developed toner image onto the intermediate transfer member 20, and a photoreceptor cleaning device 6Y that removes the toner remaining on the surface of the photoreceptor 1Y after the primary transfer are disposed in order.

Note that, the primary transfer device 5Y is disposed in the inside of the intermediate transfer member 20, and is provided at a position facing the photoreceptor 1Y. Further, a bias power supply (not shown) that applies a primary transfer bias is connected to each of the primary transfer devices 5Y, 5M, 5C, and 5K. Each of the bias power supplies allows the transfer bias applied to each of the primary transfer devices to vary.

Hereinafter, an example of an operation of forming a yellow image in the first unit 10Y will be described.

First, before the operation, the surface of the photoreceptor 1Y is charged by the charging device 2Y.

The light 3Y is output to the charged surface of the photoreceptor 1Y by the electrostatic charge image forming device 3 in response to the yellow image data. The surface of the photoreceptor 1Y is irradiated with the light 3Y, and due to this, the electrostatic charge image of a yellow image pattern is formed on the surface of the photoreceptor 1Y.

The electrostatic charge image formed on photoreceptor 1Y is rotated to a predetermined development position according to the running of photoreceptor 1Y. Then, at this development position, the electrostatic charge image on the photoreceptor 1Y is visualized (developed) as the toner image by the developing device 4Y. Specifically, as the surface of the photoreceptor 1Y passes through the developing device 4Y, a yellow toner is electrostatically attached to the erased electrostatic charge image on the surface of the photoreceptor 1Y, and the electrostatic charge image is developed with the yellow toner. The photoreceptor 1Y on which a yellow toner image is formed is subsequently moved at a predetermined speed, and the toner image developed on the photoreceptor 1Y is supplied to a predetermined primary transfer position.

When the yellow toner image on the photoreceptor 1Y is supplied to the primary transfer device 5Y, the primary transfer bias is applied to the primary transfer device 5Y, and an electrostatic force acts on the toner image from the photoreceptor 1Y to the primary transfer device 5Y. With this, the toner image on the photoreceptor 1Y is transferred onto the intermediate transfer member 20. On the other hand, toner remaining on the photoreceptor 1Y is removed by the photoreceptor cleaning device 6Y to be collected.

In this way, the intermediate transfer member 20 to which the yellow toner image has been transferred in the first unit 10Y is sequentially supplied by passing through the second to fourth units 10M, 10C, and 10K, and the toner images of respective colors are superimposed and multi-transferred.

Next, the intermediate transfer member 20 in which four toner images have been multi-transferred by passing through the first to fourth units reaches a secondary transfer unit formed of the intermediate transfer member 20, the support roller 24 contacting the inside surface of the intermediate transfer member 20, and a secondary transfer device 26 disposed on the image holding surface side of the intermediate transfer member 20. On the other hand, a recording sheet (recording medium) P is supplied to a gap in which the secondary transfer device 26 and the intermediate transfer member 20 contact each other via a supply mechanism at a predetermined timing, and the secondary transfer bias is applied to the support roller 24. At this time, the transfer bias to be applied has the same polarity as that of the toner polarity, and the electrostatic force acts on the toner image from the intermediate transfer member 20 toward the recording sheet P, and the toner image on the intermediate transfer member 20 is transferred onto the recording sheet P.

Here, the recording sheet P being accommodated in a recording sheet accommodating container is picked up by a paper supply roller (pick up roller) 31, is transported by the feed roller pair 32, and then supplied to the secondary transfer unit by a pair of positioning rollers (a pair of resist rollers) 34 at a predetermined timing.

After that, the recording sheet P is transferred to the fixing device 28 and the toner image is fixed onto the recording sheet P, thereby forming a fixed image.

The recording sheet P on which the color image is fixed is transported to the discharging portion by the pair of discharging rollers 36, and a series of color image forming operations is completed.

On the other hand, in the case of duplex printing, the recording sheet P is reversely transported (switched back) by the pair of discharging rollers 36, passes through the feeding path 38 for duplex printing constituted by the pair of feed rollers 40, 41, and 42, is transported again to the pair of positioning rollers, and is supplied to the secondary transfer unit. The recording sheet P is transferred to the fixing device 28 after the toner image is transferred to the back side, and the toner image is fixed on the recording sheet P to form a fixed image. Thereafter, the recording sheet P on which the fixing of the color image is completed is transported to the discharging portion by the pair of discharging rollers 36.

Note that, the image forming apparatus illustrated in FIG. 1 includes a controller 50 that controls the operation of each apparatus (or each part of each apparatus). Various operations of the image forming apparatus illustrated in FIG. 1 are controlled by the controller 50. That is, various operations of the image forming apparatus illustrated in FIG. 1 are performed by the controller program executed in the controller 50.

Hereinafter, a representative configuration of the image forming apparatus as illustrated in FIG. 1 will be described in detail. Note that, the reference numerals of "Y, M, C, and K" will not be described.

Photoreceptor

The photoreceptor 1 includes, for example, a conductive substrate, an undercoat layer formed on the conductive substrate, and a photosensitive layer formed on the undercoat layer. The photosensitive layer may have a two-layer structure of a charge generation layer and a charge transport layer. The photosensitive layer may be an organic photosensitive layer, and may be an inorganic photosensitive layer. The photoreceptor 1 may have a configuration in which a protective layer is provided on the photosensitive layer.

Charging Device

The charging device 2 is provided, for example, in contact or non-contact with the surface of the photoreceptor 1, and although not shown, is provided with a charging member that charges the surface of the photoreceptor 1, and a power supply which applies a charging voltage to the charging member. The power supply is electrically connected to the charging member.

Examples of the charging member of the charging device 2 include a contact-type charging device using a conductive charging roller, a charging brush, a charging film, a charging rubber blade, and a charging tube. In addition, examples of the charging member include known charging devices such as a non-contact type roller charging device, a scorotron charging device and a corotron charging device using corona discharge.

Electrostatic Charge Image Forming Device

As the electrostatic charge image forming device 3, for example, an optical system device which exposes the surface of the photoreceptor 1 with light such as semiconductor laser light, LED light, liquid crystal shutter light or the like according to an image data is exemplified. The wavelength of the light source is set to be within the spectral sensitivity area of the photoreceptor 1. Near infrared having an oscillation wavelength in the vicinity of 780 nm is widely used as a semiconductor wavelength. However, the wavelength is not limited thereto, and it is also possible to use an oscillation wavelength laser having a wavelength at a level of 600 nm or a laser having an oscillation wavelength in a range from 400 nm to 450 nm as a blue laser. In order to form a color image, a surface emitting type laser light source capable of outputting multiple beams is also effective.

Developing Device

The developing device 4 is provided, for example, on the downstream side in the rotation direction of the photoreceptor 1 from the position which is irradiated with the light 3 by the electrostatic charge image forming device 3. In the developing device 4, an accommodating portion (not shown) that accommodates the developer is provided. The electrostatic charge image developer containing the toner in the exemplary embodiment is accommodated in the accommodating portion. The toner in the exemplary embodiment is the above-described specific pulverized toner.

Although not shown, the developing device 4 is provided with a developing member that develops the electrostatic charge image formed on the surface of the photoreceptor 1 with the developer containing the toner, and a power supply that applies a developing voltage to the developing member. The developing member is, for example, electrically connected to the power supply.

The developing member of the developing device 4 is selected in accordance with the types of the developers, and examples thereof include a developing roller having a developing sleeve which covers a magnet.

In the developing device 4, for example, the developing voltage is applied to the developing member, and the developing member to which the developing voltage is applied is charged at a developing potential corresponding to the developing voltage. In addition, the developing member charged at the developing potential holds the developer accommodated in the developing device 4 on the surface, and supplies the toner contained in the developer to the surface of the photoreceptor 1 from the inside of the developing device 4.

The toner supplied onto the photoreceptor 1 is attached to the electrostatic charge image on the photoreceptor 1 by an electrostatic force. Specifically, for example, the toner contained in the developer is supplied to the area, where the electrostatic charge image is formed, of the photoreceptor by a potential difference in an area which the photoreceptor 1 and the developing member of the developing device 4 face each other, that is, by a potential difference between a potential of the surface of the photoreceptor 1 in the above area and a developing potential of the developing member of the developing device 4. Note that, in a case where carrier is contained in the developer, the carrier returns to the inside of the developing device 4 while being held by the developing member.

Primary Transfer Device

The primary transfer device 5 is provided, for example, on the downstream side of the installation position of the developing device 4 in the rotation direction of the photoreceptor 1. Although not shown, the primary transfer device 5 is provided with a transfer member that transfers the toner image formed on the surface of the photoreceptor 1 to the intermediate transfer member 20, and a power supply that applies a transfer voltage to the transfer member. The transfer member is, for example, formed in a cylindrical shape, and has the intermediate transfer member 20 nipped between the photoreceptor 1 and the transfer member. The transfer member is, for example, electrically connected to the power supply.

Examples of the transfer member of the primary transfer device 5 include a contact-type transfer charging device using a belt, a roller, a film, and a rubber blade, and known non-contact type transfer charging devices, a scorotron transfer charging device and a corotron transfer charging device using corona discharge.

Intermediate Transfer Member

Examples of the intermediate transfer member 20 include a semiconductive belt-shaped member (an intermediate transfer belt) containing polyimide, polyamideimide, polycarbonate, polyarylate, polyester, rubber or the like. In addition, as a form of the intermediate transfer member 20, a drum-shaped member may be used other than a belt-shaped member.

Secondary Transfer Device

Although not shown, the secondary transfer device 26 is provided with a transfer member that transfers the toner image formed on the surface of the intermediate transfer member 20 to the recording sheet P, and a power supply that applies a transfer voltage to the transfer member. The transfer member is, for example, formed in a cylindrical shape, and is provided such that the recording sheet P is nipped between the intermediate transfer member 20 and the transfer member. The transfer member is, for example, electrically connected to the power supply.

Examples of the transfer member of the secondary transfer device 26 include a contact-type transfer charging device using a belt, a roller, a film, and a rubber blade, and known non-contact type transfer charging devices such as a scorotron charging device and a corotron charging device using corona discharge.

Photoreceptor Cleaning Device

The photoreceptor cleaning device 6 is provided, for example, on the downstream side of the primary transfer device 5 in the rotation direction of the photoreceptor 1. The photoreceptor cleaning device 6 cleans residual toner attached on the surface of photoreceptor 1 after the toner image is transferred to the intermediate transfer member 20. In the photoreceptor cleaning device 6, deposits such as paper powder are cleaned in addition to the residual toner.

The photoreceptor cleaning device 6 is a blade type device having a blade that contacts the surface of the photoreceptor 1 so as to clean the residual toner. Further, as the photoreceptor cleaning device 6, a known cleaning device such as a brush type device is also used.

Fixing Device

Next, the fixing device 28 will be described with reference to FIG. 2.

FIG. 2 is a schematic configuration diagram indicating an example of the fixing device provided in the image forming apparatus of the exemplary embodiment.

The fixing device 28 is provided with, for example, an endless fixing belt 84, a pressurizing roller 88 (an example of the pressurizing rotator) that forms a nip portion N with the fixing belt 84 by pressurizing the outer peripheral surface of the fixing belt 84, a first heating roller 89 (an example of the first heating rotator) that is provided so as to contact the inner peripheral surface of the fixing belt 84 in the nip portion N, and heats the fixing belt 84, a second heating roller 90 (an example of the second heating unit) that is provided on the inner peripheral surface side of the fixing belt 84, and heats the fixing belt 84 from the inner peripheral surface side, and a third heating roller 92 (an example of the second heating unit) that is provided on outer peripheral surface side of the fixing belt 84 and heats the fixing belt 84 from the outer peripheral surface side.

In addition, the fixing device 28 is provided with a pair of support rollers 94 that are provided between the second heating roller 90 and the first heating roller 89, and support the fixing belt 84.

The fixing device 28 of the exemplary embodiment may have a configuration such that the fixing belt 84 is heated by the first heating roller 89 and the second heating unit (the second heating roller 90 and the third heating roller 92) other than the first heating roller 89.

The first heating roller 89 is, for example, a cylindrical roller made of aluminum, and is provided with a halogen heater 89A therein as a heating source.

The first heating roller 89 is wound around the fixing belt 84 on the side of the pressurizing roller 88 so as to be rotatory driven by a rotational force of a motor (not shown), and presses the fixing belt 84 from the inner peripheral surface thereof toward the pressurizing roller 88 so as to heat the fixing belt 84 (nip portion N) from the inner peripheral surface side.

The second heating roller 90 is, for example, a cylindrical roller made of aluminum, is provided with a halogen heater 90A therein as a heating source, and heats the fixing belt 84 from the inner peripheral surface side.

A spring member (not shown) that presses the fixing belt 84 to the outside, for example, is disposed at both ends of the second heating roller 90 in the axial direction.

The third heating roller 92 is, for example, a cylindrical roller made of aluminum, and a release layer including a fluorine resin having a thickness of 20 μm is formed on the surface of the third heating roller 92.

The release layer of the third heating roller 92 is formed so as to prevent toner and paper powder from the outer peripheral surface of the fixing belt 84 from being moved to and deposited on the outer peripheral surface of the third heating roller 92.

The third heating roller 92 is provided with, for example, a halogen heater 92A therein as a heating source, and heats the fixing belt 84 from the outer peripheral surface side.

A spring member (not shown) that presses the fixing belt 84 to the inside, for example, is disposed at both ends of the third heating roller 90 in the axial direction.

The pair of support rollers 94 are, for example, cylindrical rollers made of aluminum.

On the other hand, for example, the pressurizing roller 88 is provided to be rotatably supported and is pressed at a portion where the fixing belt 84 is wound around the first heating roller 89 by an urging unit such as a spring (not shown). With this, as the fixing belt 84 rotates in the direction of an arrow S, the pressurizing roller 88 is rotated in the direction of an arrow R following the fixing belt 84 and the first heating roller 89.

Then, when paper K (an example of the recording medium) having an unfixed toner image (not shown) is transported in the direction of an arrow P and guided to the nip portion N of the fixing device 28, the toner image is fixed by the pressure and heat acting on the nip portion N.

Note that, in the fixing device 28 of the exemplary embodiment, as a mode of the heating of the fixing belt 84, a mode in which the fixing belt 84 is heated by the first heating rotator (the first heating roller 89) that is provided so as to contact the inner peripheral surface of the fixing belt in the nip portion, and two second heating units (the second heating roller 90 and the third heating roller 92) which are provided in addition to the first heating roller 89 is described; however, the mode is not limited thereto.

For example, examples of the mode of the heating of the fixing belt include a mode of heating the fixing belt by the first heating rotator, and one or more of the second heating units provided on the inner peripheral surface side of the fixing belt; a mode of heating the fixing belt by the first heating rotator, and one or more of the second heating units provided on the outer peripheral surface side of the fixing belt; and a mode of above two modes.

As a preferable mode of heating the fixing belt, a mode of heating the fixing belt by the first heating rotator, one or more of the second heating units provided on the inner peripheral surface side of the fixing belt, and one or more of the second heating units provided on the outer peripheral surface side of the fixing belt is exemplified.

In this regard, as described above, an area to be heated, in which the fixing belt is heated by at least one heating unit of one or more of the second heating units is preferably provided in an area on the downstream side of the nip portion in the rotation direction of the fixing belt and within 50% of the circumferential length of the fixing belt from the nip portion.

Further, in the fixing device 28, a mode in which the halogen heater (the halogen lamp) is applied as an example of the heating source of the first heating rotator and the second heating unit has been described, but not limited thereto. For example, a radiant lamp heating member (a heating member that generates radiation (infrared ray or the like) other than the halogen heater, a resistance heating member (a heating member that generates Joule heat by allowing current to flow a resistor: for example, that obtained by forming a film having a thick film resistance on a ceramic substrate and then performing firing) may be applied.

As the heating source of the second heating unit, electromagnetic induction heating (IH) may be applied.

When two or more of the second heating units are provided, the second heating units may be the same as or different from each other.

Further, in the fixing device 28, the mode of applying the pressurizing roller as an example of the pressurizing rotator has been described, but there is no limitation thereto.

A pressurizing belt may be applied.

Electrostatic Charge Image Developing Toner

In the image forming apparatus according to the exemplary embodiment, the developer accommodated in the developing unit contains the above specific pulverized toner.

The toner (specific pulverized toner) includes toner particles containing a binder resin which contains an amorphous resin and a crystalline resin, and paraffin wax having a melting temperature in a range from 60° C. to 80° C., and if necessary, external additives.

In addition, a toluene-insoluble portion of the toner is from 25% by weight to 45% by weight.

Toluene-Insoluble Portion

In the toner in the exemplary embodiment, the content of the toluene-insoluble portion is from 25% by weight to 45% by weight. The toluene-insoluble portion means an index of the content of the crosslinked resin contained in the toner.

The toluene-insoluble portion is preferably from 28% by weight to 38% by weight, and is further preferably from 30% by weight to 35% by weight.

When the toluene-insoluble portion is equal to or greater than 25% by weight, it is likely to obtain excellent low temperature fixability, and an increase in glossiness (gloss) in an image is likely to be prevented.

When the toluene-insoluble portion is equal to or less than 45% by weight, poor fixing is less likely to occur.

The toluene-insoluble portion is adjusted, in the binder resin, by 1) a method of forming a crosslinked structure or a branched structure by adding a crosslinking agent to a polymer component having a reactive functional group at the terminal, 2) a method of forming a crosslinked structure or a branched structure by a polyvalent metal ion in a polymer component having an ionic functional group at the terminal, and 3) a method of forming the extension and branch of the resin chain length by a treatment with isocyanate or the like.

Here, the toluene-insoluble portion is a component of the toner. In other words, the toluene-insoluble portion is an insoluble portion in which the component (particularly, the high molecular weight component of the binder resin) of the toluene-insoluble binder resin is set as a main component. This toluene-insoluble portion may be said as an index of the content of crosslinked resin contained in toner.

The toluene-insoluble portion is a value measured by the following method.

1 g of weighed toner is put into a weighed cylindrical filter paper made of glass fiber and placed in an extraction tube of a heating type Soxhlet extraction apparatus. Then, toluene is put into a flask, and is heated to 110° C. using a mantle heater. Also, the circumference of an extraction tube is heated to 125° C. using a heater mounted on the extraction tube. Extraction is performed with a reflux rate such that one extraction cycle is within the range from 4 minutes to 5 minutes. After extracting for 10 hours, the cylindrical filter paper and the toner residue are taken out, dried, and weighed.

In addition, based on Expression: toner residue amount (% by weight)=[(cylindrical filter paper amount+toner residue amount) (g)−cylindrical filter paper amount (g)]/toner amount (g)×100, the toner residue amount (% by weight) is calculated, and the calculated toner residue amount (% by weight) is set as the toluene-insoluble portion (% by weight).

Note that, the toner residue is formed of inorganic substances such as coloring agent, external additives, and a high molecular weight component of the binder resin. In addition, in a case where the release agent is contained in the toner particles, the extraction is performed by heating, and thus the release agent is set as the toluene soluble portion.

Hereinafter, components of the toner in the exemplary embodiment will be described.

Toner Particles

The toner particles are configured to include, for example, a binder resin, a release agent containing at least paraffin wax, and if necessary, a coloring agent and other additives.

Binder Resin

As the binder resin, an amorphous resin and a crystalline resin are used in combination. In the binder resin, the crystalline resin is used in addition to the amorphous resin, and thus it is possible to obtain excellent low temperature fixability.

Here, the amorphous resin means a resin having only a stepwise endothermic change without a definite endothermic peak in a thermal analysis measurement using differential scanning calorimetry (DSC), and is a solid at room temperature and thermoplastic at a temperature equal to or higher than a glass transition temperature.

On the other hand, the crystalline resin means a resin having a definite endothermic peak without a stepwise endothermic change in the differential scanning calorimetry (DSC).

Specifically, for example, the crystalline resin means that the half-width of the endothermic peak when measured at a heating rate of 10° C./min is within 10° C., and the amorphous resin means a resin having the half-width of greater than 10° C., or a resin in which the definite endothermic peak is not recognized.

An amorphous resin will be described.

Examples of the amorphous resin include known resin materials such as a styrene acrylic resin, an epoxy resin, a polyester resin, a polyurethane resin, a polyamide resin, a cellulose resin, a polyether resin, and a polyolefin resin. Among them, the amorphous polyester resin is particularly preferable.

The amorphous polyester resin will be described.

Examples of the amorphous polyester resin include condensation polymers of polyvalent carboxylic acids and polyol. A commercially available product or a synthesized product may be used as the amorphous polyester resin.

Examples of the polyvalent carboxylic acid include aliphatic dicarboxylic acid (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acid (for example, cyclohexane dicarboxylic acid), aromatic dicarboxylic acid (for example, terephthalic acid, isophthalic acid, phthalic acid, and naphthalene dicarboxylic acid), and an anhydride thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, tri- or higher-valent carboxylic acid employing a crosslinked structure or a branched structure may be used in combination together with dicarboxylic acid. Examples of the tri- or higher-valent carboxylic acid include trimellitic acid, pyromellitic acid, anhydrides thereof, or lower alkyl esters (having, for example, 1 to 5 carbon atoms) thereof.

The polyvalent carboxylic acids may be used alone or two or more types thereof may be used in combination.

Examples of the polyol include aliphatic diol (for example, ethylene glycol, diethylene glycol, triethylene glycol, propylene glycol, butanediol, hexanediol, and neopentyl glycol), alicyclic diol (for example, cyclohexanediol, cyclohexane dimethanol, and hydrogenated bisphenol A), aromatic diol (for example, an ethylene oxide adduct of bisphenol A, and a propylene oxide adduct of bisphenol A). Among these, for example, aromatic diols and alicyclic diols are preferably used, and aromatic diols are further preferably used as the polyol.

As the polyol, a tri- or higher-valent polyol employing a crosslinked structure or a branched structure may be used in combination together with diol. Examples of the tri- or higher-valent polyol include glycerin, trimethylolpropane, and pentaerythritol.

The polyol may be used alone and two or more types thereof may be used in combination.

The glass transition temperature (Tg) of the amorphous polyester resin is preferably of 50° C. to 80° C., and further preferably of 50° C. to 65° C.

The glass transition temperature is obtained from a DSC curve obtained by differential scanning calorimetry (DSC). More specifically, the glass transition temperature is obtained from "extrapolated glass transition onset temperature" described in the method of obtaining a glass transition temperature in JIS K 7121-1987 "testing methods for transition temperatures of plastics".

The weight average molecular weight (Mw) of the amorphous polyester resin is preferably from 5,000 to 1,000,000, and is further preferably from 7,000 to 500,000.

The number average molecular weight (Mn) of the amorphous polyester resin is from 2,000 to 100,000.

The molecular weight distribution Mw/Mn of the amorphous polyester resin is preferably from 1.5 to 100, and is further preferably from 2 to 60.

The weight average molecular weight and the number average molecular weight are measured by gel permeation chromatography (GPC). The molecular weight measurement by GPC is performed using HLC-8120 GPC, which is a GPC manufactured by Tosoh Corporation as a measuring device, TSK gel Super HM-M (15 cm), which is a column manufactured by Tosoh Corporation, and a THF solvent. The weight average molecular weight and the number average molecular weight are calculated by using a molecular weight calibration curve plotted from a monodisperse polystyrene standard sample from the results of the foregoing measurement.

A known preparing method is used to produce the amorphous polyester resin. Specific examples thereof include a method of conducting a reaction at a polymerization temperature set to be from 180° C. to 230° C., if necessary, under reduced pressure in the reaction system, while removing water or an alcohol generated during condensation.

When monomers of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. When a monomer having poor compatibility is present, the monomer having poor compatibility and an acid or an alcohol to be polycondensed with the monomer may be previously condensed and then polycondensed with the major component.

The crystalline resin will be described.

Examples of the crystalline resin include a polyester resin and crystalline vinyl resin, and a crystalline polyester resin is particularly preferable.

The crystalline polyester resin will be described.

Examples of the crystalline polyester resin include condensation polymers of polyvalent carboxylic acids and polyol. A commercially available product or a synthesized product may be used as the crystalline polyester resin.

Here, in order to easily form a crystal structure, the crystalline polyester resin is preferably a polycondensate using a polymerizable monomer having a linear aliphatic group rather than a polymerizable monomer having an aromatic group.

Examples of the polyvalent carboxylic acid include aliphatic dicarboxylic acid (for example, oxalic acid, succinic acid, glutaric acid, adipic acid, suberic acid, azelaic acid, sebacic acid, 1,9-nonane dicarboxylic acid, 1,10-decane dicarboxylic acid, 1,12-dodecane dicarboxylic acid, 1,14-tetradecane dicarboxylic acid, and 1,18-octadecane dicarboxylic acid), aromatic dicarboxylic acid (for example, dibasic acid such as phthalic acid, isophthalic acid, terephthalic acid, and naphthalene-2,6-dicarboxylic acid), and an anhydride thereof, or lower alkyl esters (having, for example, from 1 to 5 carbon atoms) thereof.

As the polyvalent carboxylic acid, tri- or higher-valent carboxylic acid employing a crosslinked structure or a branched structure may be used in combination together with dicarboxylic acid. Examples of the tri-valent carboxylic acid include aromatic carboxylic acid (for example, 1,2,3-benzene tricarboxylic acid, 1,2,4-benzene tricarboxylic acid, and 1,2,4-naphthalene tricarboxylic acid), and anhydrides thereof, or lower alkyl esters (having, for example, 1 to 5 carbon atoms) thereof.

As the polycarboxylic acid, a dicarboxylic acid having a sulfonic acid group and a dicarboxylic acid having an ethylenic double bond may be used together with these dicarboxylic acids.

The polyvalent carboxylic acids may be used alone or two or more types thereof may be used in combination.

Examples of the polyol include aliphatic diol (for example, a linear type aliphatic diol having 7 to 20 carbon atoms in a main chain portion). Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among them, as the aliphatic diol, 1,8-octanediol, 1,9-nonanediol, and 1,10-decanediol are preferably used.

As the polyol, a tri- or higher-valent polyol employing a crosslinked structure or a branched structure may be used in combination together with diol. Examples of the tri- or higher-valent polyol include glycerin, trimethylolethane, trimethylolpropane, and pentaerythritol.

The polyol may be used alone or two or more types thereof may be used in combination.

Here, in the polyol, the content of the aliphatic diol may be equal to or greater than 80% by mol, and is preferably equal to or greater than 90% by mol.

The melting temperature of the crystalline polyester resin is preferably from 50° C. to 100° C., is further preferably from 55° C. to 90° C., and is still further preferably from 60° C. to 85° C.

Note that, the melting temperature is obtained from a DSC curve obtained by differential scanning calorimetry (DSC), and specifically obtained from "melting peak temperature" described in the method of obtaining a melting temperature in JIS K 7121-1987 "testing methods for transition temperatures of plastics".

The weight average molecular weight (Mw) of the crystalline polyester resin is preferably from 6,000 to 35,000.

Note that, the weight average molecular weight and the number average molecular weight is measured similarly to the case of the amorphous polyester resin by gel permeation chromatography (GPC).

The crystalline polyester resin is obtained, for example, by a known preparing method similar to the case of the amorphous polyester resin.

The content of the crystalline resin is, for example, preferably from 3% by weight to 20% by weight, and is further preferably from 5% by weight to 15% by weight with respect to the entire amount of the toner particles.

Release Agent

As the release agent, the paraffin wax having a melting temperature in a range from 60° C. to 80° C. is used. When the melting temperature of the release agent is equal to or lower than 80° C., it is possible to obtain excellent low temperature fixability; on the other hand, when the melting temperature is equal to or higher than 60° C., the storage stability of the toner is enhanced.

Examples of the paraffin wax include polyethylene type wax and polypropylene type wax.

The melting temperature of the paraffin wax is preferably from 65° C. to 78° C., and is further preferably from 65° C. to 75° C.

Note that, the melting temperature is obtained from a DSC curve obtained by differential scanning calorimetry (DSC), and specifically obtained from "melting peak temperature" described in the method of obtaining a melting temperature in JIS K 7121-1987 "testing methods for transition temperatures of plastics".

The content of the release agent is preferably from 1% by weight to 20% by weight, and is further preferably from 5% by weight to 15% by weight with respect to the entire toner particles.

Note that, the release agent may contain release agents (hereinafter, may be simply referred to as "other release agents") other than the paraffin wax.

Examples of other release agents include paraffin wax having a melting temperature of lower than 60° C. or higher than 80° C.; hydrocarbon waxes other than paraffin wax; natural waxes such as carnauba wax, rice wax, and candelilla wax; synthetic or mineral/petroleum waxes such as montan wax; and ester waxes such as fatty acid esters and montanic acid esters. However, other release agents are not limited to the above examples.

In a case where the release agent contains other release agents, the content of the paraffin wax having a melting temperature in a range from 60° C. to 80° C. is preferably greater than 50% by weight, and is further preferably equal to or greater than 60% by weight with respect to the entire release agents.

Absolute Value of Difference Between Melting Temperature of Crystalline Resin and Melting Temperature of Paraffin Wax The toner particles in the exemplary embodiment include the crystalline resin and the paraffin wax (release agent) having a melting temperature in a range from 60° C. to 80° C., and the absolute value of the difference between the melting temperature of the crystalline resin and the melting temperature of the paraffin wax is equal to or lower than 10° C.

The absolute value of the above difference is preferably equal to or lower than 8° C., and is further preferably equal to or lower than 5° C.

When the absolute value of the above difference is equal to or lower than 10° C., it is possible to obtain the excellent fixability.

Note that, the smaller the absolute value of the difference is, the better.

Coloring Agent

Examples of the coloring agent include various types of pigments such as carbon black, chrome yellow, Hansa yellow, benzidine yellow, threne yellow, quinoline yellow, pigment yellow, Permanent Orange GTR, Pyrazolone Orange, Vulcan Orange, Watch Young Red, Permanent Red, Brilliant Carmine 3B, Brilliant Carmine 6B, DuPont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, and Malachite Green Oxalate, or various types of dyes such as acridine dye, xanthene dye, azo dye, benzoquinone dye, azine dye, anthraquinone dye, thioindigo dye, dioxazine dye, thiazine dye, azomethine dye, indigo dye, phthalocyanine dye, aniline black dye, polymethine dye, triphenylmethane dye, diphenylmethane dye, and thiazole dye.

The coloring agents may be used alone or two or more types thereof may be used in combination.

As the coloring agent, if necessary, a surface-treated coloring agent may be used, or a dispersant may be used in combination. Further, plural kinds of coloring agents may be used in combination.

The content of the coloring agent is preferably from 1% by weight to 30% by weight, and is further preferably from 3% by weight to 15% by weight with respect to the entire toner particles.

Other Additives

Examples of other additives include well-known additives such as a magnetic material, a charge-controlling agent, and an inorganic powder. These additives are contained in the toner particle as internal additives.

Volume Average Particle Diameter of Toner Particles

The volume average particle diameter of the toner particles is from 6 μm to 9 μm.

The volume average particle diameter of the toner particles is preferably from 6.5 μm to 8 μm, and is further preferably from 6.5 μm to 7.5 μm. When the volume average particle diameter of the toner particles is equal to or greater than 6 μm, the preparing suitability at the time of the preparation by the pulverization method is obtained. On the other hand, when the volume average particle diameter is equal to or less than 9 μm, it is easy to obtain high quality images.

The volume average particle diameter of the toner particles is measured using a COULTER MULTISIZER II (manufactured by Beckman Coulter, Inc.) and ISOTON-II (manufactured by Beckman Coulter, Inc.) as an electrolyte.

In the measurement, 0.5 mg to 50 mg of a measurement sample is added to 2 ml of a 5% aqueous solution of surfactant (preferably sodium alkylbenzene sulfonate) as a dispersing agent. The obtained material is added to 100 ml to 150 ml of the electrolyte.

The electrolyte in which the sample is suspended is subjected to a dispersion treatment using an ultrasonic disperser for one minute, and a particle diameter distribution of particles having a particle diameter of from 2 μm to 60 μm is measured by a COULTER MULTISIZER II using an aperture having an aperture diameter of 100 μm. 50,000 particles are sampled.

Volume cumulative distributions are drawn from the side of the smallest diameter with respect to particle diameter ranges (channels) separated based on the measured particle diameter distribution, and then the particle diameter when the cumulative percentage becomes 50% is defined as volume average particle diameter D50v.

Shape Factor SF1 of Toner Particles

The shape factor SF1 of the toner particles is equal to or greater 140. When the shape factor SF1 of the toner particles is equal to or greater than 140, the preparing suitability at the time of the preparation by the pulverization method may be obtained.

The shape factor SF1 of the toner particles is preferably equal to or greater than 143, and is further preferably equal to or greater than 145. The upper limit value of the shape factor SF1 is preferably equal to or less than 155, is further preferably equal to or less than 153, and is still further preferably equal to or less than 151 from the viewpoint that a shape relatively close to a sphere is obtained and it is easy to obtain a high quality image.

Generally, the toner particles having the shape factor SF1 of equal to or greater than 140 are prepared by using the pulverization method such as a kneading and pulverizing method.

For example, the toner particles prepared by using the kneading and pulverizing method are irregular-shaped, but when being combined with the image forming apparatus provided with the fixing device as described above, the fixability becomes excellent.

The method of preparing the toner particles by using the kneading and pulverizing method will be described below.

The shape factor SF1 of the toner particles is calculated by the following Expression (1).

$$SF1=(ML^2/A)\times(\pi/4)\times 100 \quad \text{Expression (1):}$$

In Expression (1), ML represents an absolute maximum length of the toner particles, and A represents a projected area of the toner particles.

Specifically, the shape factor SF1 is digitized by analyzing mainly a scanning electron microscope (SEM) image using an image analyzer, and is calculated as follows. That is, the shape factor SF1 is obtained by capturing a microscopic image of particles scattered on the surface of the slide glass into a LUZEX image analyzer by using a video camera, calculating the maximum length and the projected area of 100 particles and calculating SF1 for each of the particles by the above Expression, and then based on the calculation, the average value for 100 particles is calculated.

The shape factor SF1 of the toner particles may be controlled, for example, by adjusting the control parameters of the pulverization and classification equipment when the toner particles are prepared by using the kneading and pulverizing method.

External Additives

Examples of the external additives include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

Surfaces of the inorganic particles as an external additive are preferably treated with a hydrophobizing agent. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, from 1 part by weight to 10 parts by weight with respect to 100 parts by weight of the inorganic particles.

Examples of the external additive include a resin particle (resin particles of, for example, such as polystyrene, polymethyl methacrylate (PMMA), and melamine resin), a cleaning aid (for example, metal salts of higher fatty acids typified by zinc stearate, and particles of fluorine high molecular weight polymer).

The external addition amount of the external additives is, for example, preferably from 0.01% by weight to 5% by weight, and is further preferably from 0.01% by weight to 2.0% by weight with respect to the toner particles.

Preparing Method of Toner

Next, a method of preparing the toner according to the exemplary embodiment will be described.

The toner according to the exemplary embodiment is obtained by externally adding the external additives to the toner particles after preparing the toner particles.

As described above, the toner particles in the exemplary embodiment are amorphous toner particles (that is, the shape factor SF1 is equal to or greater than 140). The toner particles are generally prepared by using the pulverization method such as a kneading and pulverizing method.

The kneading and pulverizing method is a method of preparing the toner particles by molten kneading the binder resin and the release agent containing the specific paraffin wax having a melting temperature within the above-described range, and then pulverizing and classifying the resultant. Specifically, the kneading and pulverizing method includes a kneading step of molten kneading the binder resin and the release agent, a cooling step of cooling the molten-kneaded material, a pulverizing step of pulverizing the kneaded material after cooling, and a classification step of classifying the pulverized material.

Hereinafter, each step of the kneading and pulverizing method will be described in detail.

Kneading Step

In the kneading step, molten kneading of a resin particle forming material containing a binder resin and a release agent.

Examples of a kneading machine used in the kneading step include a three-roll extruder, a single-screw extruder, a twin-screw extruder, and a BANBURY mixer extruder.

In addition, the melting temperature may be determined in accordance with the kinds and a blend ratio of the binder resin and the release agent to be kneaded.

Cooling Step

A cooling step is a step of cooling the kneaded material formed in the above-described kneading step.

In the cooling step, the temperature of the kneaded material at the time of completing the kneading step is desired to be cooled down to be equal to or lower than 40° C. at an average temperature lowering speed of equal to or higher than 4° C./sec in order to keep the dispersed state immediately after the kneading step.

Note that, the average temperature lowering speed means an average value of the speed at which the temperature of the kneaded material at the time of completing the kneading step is cooled down to 40° C.

Specifically, examples of the cooling method in the cooling step include a method of using a rolling roller which circulates cold water or brine, and a pinched type cooling belt. Note that, in a case where the cooling is performed by using the above-described method, the cooling speed is determined by a speed of the rolling roller, a flow rate of the brine, a supply amount of the kneaded material, a slab thickness during the rolling of the kneaded material. The slab thickness is preferably from 1 mm to 3 mm.

Pulverizing Step

The kneaded material which is cooled in the cooling step is pulverized in the pulverizing step so as to form a particle.

In the pulverizing step, for example, a mechanical pulverizer or a jet type pulverizer is used.

Classification Step

The pulverized materials (particles) obtained in the pulverizing step may be classified in the classification step so as to obtain toner particles having a volume average particle diameter of 6 μm to 9 μm, if necessary.

In the classification step, fine powder (particles smaller than the target diameter range) and coarse powder (particles larger than the target diameter range) are removed by using a centrifugal classifier, an inertial classifier, or the like which are conventionally used.

Through the above steps, it is possible to obtain the toner particles of which the shape factor SF1 is equal to or greater than 140, and the volume average particle diameter is from 6 μm to 9 μm.

Through the above steps, it is possible to obtain the toner particles.

In addition, the toner according to the exemplary is prepared by adding and mixing, for example, an external additive to the obtained dry toner particles. The mixing may be performed with, for example, a V-blender, a HENSCHEL MIXER, a LODIGE MIXER, or the like. Furthermore, if necessary, coarse particles of the toner may be removed by using a vibration sieving machine, a wind classifier, or the like.

Electrostatic Charge Image Developer

The electrostatic charge image developer according to the exemplary embodiment includes at least the toner according to the exemplary embodiment.

The electrostatic charge image developer according to the exemplary embodiment may be a one-component developer only including the toner according to the exemplary embodiment, or may be a two-component developer obtained by mixing the toner and carrier.

The carrier is not particularly limited, and a well-known carrier may be used. Examples of the carrier include a coating carrier in which the surface of the core formed of magnetic particles is coated with the coating resin; a magnetic particle dispersion-type carrier in which the magnetic particles are dispersed and distributed in the matrix resin; and a resin impregnated-type carrier in which a resin is impregnated into the porous magnetic particles.

Note that, the magnetic particle dispersion-type carrier and the resin impregnated-type carrier may be a carrier in which the constituent particle of the carrier is set as a core and the core is coated with the coating resin.

Examples of the magnetic particle include a magnetic metal such as iron, nickel, and cobalt, and a magnetic oxide such as ferrite, and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid ester copolymer, a straight silicone resin formed by containing an organosiloxane bond or a modified product thereof, a fluorine resin, polyester, polycarbonate, a phenol resin, and an epoxy resin.

Note that, other additives such as the conductive particles may be contained in the coating resin and the matrix resin.

Examples of the conductive particle include particles of metal such as gold, silver, and copper, carbon black, titanium oxide, zinc oxide, tin oxide, barium sulfate, aluminum borate, and potassium titanate.

Here, in order to coat the surface of the core with the coating resin, a method of coating the surface with a coating layer forming solution in which the coating resin and various additives if necessary are dissolved in a proper solvent is used. The solvent is not particularly limited and may be selected in consideration of a coating resin to be used and coating suitability.

Specific examples of the resin coating method include a dipping method of dipping the core into the coating layer forming solution, a spray method of spraying the coating layer forming solution onto the surface of the core, a fluid-bed method of spraying the coating layer forming solution to the core in a state of being floated by the flowing air, and a kneader coating method of mixing the core of the carrier with the coating layer forming solution in the kneader coater and removing a solvent.

The mixing ratio (weight ratio) of the toner to the carrier in the two-component developer is preferably from toner: carrier=1:100 to 30:100, and is further preferably from 3:100 to 20:100.

As described above, with reference to the drawings, the image forming apparatus has been described byway of an example, but the embodiment is not limited thereto.

EXAMPLES

Hereinafter, the exemplary embodiments will be described in detail using Examples and Comparative Examples, but is not limited to the following examples.

Preparation of Crystalline Resin (A)

First, 100 parts by weight of dimethyl sebacate, 67.8 parts by weight of hexane diol, and 0.10 parts by weight of dibutyl tin oxide are put into a three-necked flask, the mixture is reacted at 185° C. for five hours under nitrogen atmosphere while removing water generated during the reaction to the outside, and after being reacted for six hours after raising the temperature up to 220° C. while slowly depressurizing, the resultant is cooled. In this way, a crystalline resin (A) having a weight average molecular weight of 33,700 is prepared.

Note that, the melting temperature of the crystalline resin (A) is obtained from a DSC curve obtained by differential scanning calorimetry (DSC) based on "melting peak temperature" described in the method of obtaining a melting temperature in JIS K 7121-1987 "testing methods for transition temperatures of plastics", and the measured temperature is 71° C.

Preparation of Amorphous Resin (1)

61 parts by weight of dimethyl terephthalate, 75 parts by weight of dimethyl fumarate, 34 parts by weight of dodecenyl succinic anhydride, 16 parts by weight of trimellitic acid, 137 parts by weight of bisphenol A ethylene oxide adduct, 191 parts by weight of bisphenol A propylene oxide adduct, and 0.3 parts by weight of dibutyl tin oxide are put into a three-necked flask, the mixture is reacted at 180° C. for three hours under nitrogen atmosphere while removing water generated during the reaction to the outside, and after being reacted for two hours after raising the temperature up to 240° C. while slowly depressurizing, the resultant is cooled. In this way, an amorphous resin (1) having a weight average molecular weight of 17,100 is prepared.

Preparation of Amorphous Resin (2)

An amorphous resin (2) is prepared in the same manner as in the preparation of the amorphous resin (1) except that the component compositions are changed to 60 parts by weight of dimethyl terephthalate, 74 parts by weight of dimethyl fumarate, 30 parts by weight of dodecenyl succinic anhydride, and 22 parts by weight of trimellitic acid. The weight average molecular weight of the amorphous resin (2) is 17,500.

Preparation of Amorphous Resin (3)

An amorphous resin (3) is prepared in the same manner as in the preparation of the amorphous resin (1) except that the component compositions are changed to 60 parts by weight of dimethyl terephthalate, 70 parts by weight of dimethyl fumarate, 29 parts by weight of dodecenyl succinic anhydride, and 29 parts by weight of trimellitic acid. The weight average molecular weight of the amorphous resin (3) is 16,600.

Preparation of Amorphous Resin (4)

An amorphous resin (4) is prepared in the same manner as in the preparation of the amorphous resin (1) except that the component compositions are changed to 55 parts by weight of dimethyl terephthalate, 64 parts by weight of dimethyl fumarate, 27 parts by weight of dodecenyl succinic anhydride, and 46 parts by weight of trimellitic acid. The weight average molecular weight of the amorphous resin (4) is 15,100.

Preparation of Toner (1)

79 parts by weight of amorphous resin (1), 7 parts by weight of coloring agent (C.I. Pigment Blue 15:1), 5 parts by weight of release agent (paraffin wax, melting temperature 73° C., prepared by Nippon Seiro Co., Ltd.), and 8 parts by weight of the crystalline resin A (melting temperature 71° C.) are put into a HENSCHEL MIXER (manufactured by NIPPON COKE & ENGINEERING Co., Ltd.), and are mixed and stirred at a peripheral speed of 15 m/sec for five minutes, and then the obtained stirred mixture is molten-kneaded by an extruder type continuous kneader.

Here, the setting condition of the extruder is that a supply side temperature is 160° C., a discharge side temperature is 130° C., the supply side temperature and the discharge side temperature of the cooling roller are 40° C. and 25° C., respectively. Note that, the temperature of the cooling belt is set to be 10° C.

After being cooled, the obtained molten-kneading material is roughly pulverized by using a hammer mill, is finely pulverized such that a diameter thereof becomes 6.5 μm by using a jet mill-pulverizer (manufactured by Nippon Pneumatic Mfg. Co., Ltd.), and then is classified by using an elbow jet classifier (Nittetsu Mining Co., Ltd. Model: EJ-LABO), thereby obtaining toner particles (1).

The volume average particle diameter of the toner particles (1) is 6.9 μm, and the shape factor SF1 is 145.

The volume average particle diameter and SF1 are measured by using the above-described method. The results are indicated in Table 1. The same applies hereafter.

100 parts by weight of the toner particles (1) and 1.2 parts by weight of commercially available fumed silica RX50 (prepared by Nippon Aerosil Co., Ltd.) as the external additives are mixed at a peripheral speed of 30 m/s, for five minutes by using a HENSCHEL MIXER (manufactured by Mitsui Miike Machinery Co., Ltd.). As a result, a toner (1) is obtained.

Preparation of Toner (2)

Toner particles (2) are obtained in the same manner as in Example 1 except that an amorphous resin (2) is used instead of the amorphous resin (1).

The volume average particle diameter of the toner particles (2) is 6.8 μm, and the shape factor SF1 is 147.

Then, a toner (2) is obtained in the same manner as in the case of the toner (1) except that the toner particles (2) are used.

Preparation of Toner (3)

Toner particles (3) are obtained in the same manner as in Example 1 except that an amorphous resin (3) is used instead of the amorphous resin (1).

The volume average particle diameter of the toner particles (3) is 7.0 μm, and the shape factor SF1 is 149.

Then, a toner (3) is obtained in the same manner as in the case of the toner (1) except that the toner particles (3) are used.

Preparation of Toner (4)

Toner particles (4) are obtained in the same manner as in Example 1 except that an amorphous resin (4) is used instead of the amorphous resin (1).

The volume average particle diameter of the toner particles (4) is 7.3 μm, and the shape factor SF1 is 151.

Then, a toner (4) is obtained in the same manner as in the case of the toner (1) except that the toner particles (4) are used.

Preparation of Toner (1C)

Toner particles (1C) are obtained in the same manner as in Example 1 except that paraffin wax (HNP9, melting temperature 77° C., prepared by Nippon Seiro Co., Ltd.) is used instead of the paraffin wax used in Example 1.

The volume average particle diameter of the toner particles (1C) is 7.0 μm, and the shape factor SF1 is 146.

Then, a toner (1C) is obtained in the same manner as in the case of the toner (1) except that the toner particles (1C) are used.

Measuring of Toluene-Insoluble Portion

The toluene-insoluble portion of the toner obtained in each Example is measured by using the above-described method. The results are indicated in Table 1.

Preparation of Developer

A two-component developer is prepared by mixing 8 parts by weight of toner obtained in each example and 100 parts by weight of carrier.

The carrier is obtained in such a manner that 100 parts by weight of ferrite particles (the volume average particle diameter: 50 μm), 14 parts by weight of toluene, and 2 parts by weight of styrene-methyl methacrylate copolymer (component ratio: styrene/methyl methacrylate=90/10, the weight average molecular weight Mw=80,000) are prepared, then these components except for ferrite particles are dispersed by being stirred for 10 minutes by using stirrer so as to prepare a coating solution. Then, the coating solution and the ferrite particles are put into a vacuum degassing type kneader (manufactured by Inoue Seisakusho Co., Ltd), the mixture is stirred at 60° C. for 30 minutes, the pressure is reduced to further degas while warming up the mixture, so that the mixture is dried, and then classifying with a mesh of 105 μm is performed.

Evaluation

As an image forming apparatus, COLOR 1000 PRESS manufactured by Fuji Xerox Co., Ltd) is prepared. A developer including any one of the toners (1) to (4), and the toner (1C) is accommodated in a developing device of the image forming apparatus, and the image forming apparatuses are referred to as image forming apparatuses of Examples 1 to 4, and Comparative Example (C1), respectively.

Each of the image forming apparatuses of Examples 1 to 4 is provided with a fixing device which has the same configuration as that of the fixing device as illustrated in FIG. 2 (that is, the fixing device provided with the fixing belt 84, the pressurizing roller 88 (the pressurizing rotator) that forms the nip portion N by pressurizing the outer peripheral surface of the fixing belt 84, the first heating roller 89 (the first heating rotator) that heats the fixing belt 84 by contacting the inner peripheral surface of the fixing belt 84 in the nip portion N, the second heating roller 90 (the second heating unit) that heats the fixing belt 84 from the inner peripheral surface side, and a third heating roller 92 (the second heating unit) that heats the fixing belt 84 from the outer peripheral surface side.

In addition, the image forming apparatus of Comparative Example 1 is provided with, as a unit that heats the fixing belt, a fixing device having the same configuration as that of the fixing device illustrated in FIG. 2 except that the fixing device includes the first heating roller 89 but does not include the second heating roller 90 and the third heating roller 92.

The paper transport speed (process speed) at the time of forming an image is set to 360 mm/sec, and the fixing temperature is set to 170° C. (set temperature of the first heating roller). The setting temperature of the second heating roller is set to 190° C., and the setting temperature of the third heating roller is set to 190° C.

Fixability

With A4 paper (C2 paper, manufactured by Fuji Xerox Co., Ltd), 500 images (solid images) with an image density of 100% are output under the environment of a temperature of 28° C. and a humidity of 85% RH.

Regarding the image output on the 100th paper, the paper is folded in half with the image surface facing inward, a pressure load of 10 g/cm$^2$ is applied to the fold for one minute, then the paper folded in half is opened and is lightly wiped with gauze to trace the folded part. At this time, a degree of the image defects is visually evaluated based on the following criteria. The allowable range is equal to or greater than G2. The results are indicated in Table 1.

Evaluation Criteria

Fixability

G1: No image defect at all

G2: Streaks are lightly observed (the width is 100 μm or less)

G3: Image defects are observed (the width is greater than 100 μm)

Releasability

In the evaluation test for the fixability, a solid image is output to the A4 paper while narrowing a margin part on the front side in the paper transport direction. Specifically, first, a solid image is output such that the width (the length in the paper transport direction) of the margin part on the front side in the paper supply direction is 5 mm. After that, the solid images are sequentially output while narrowing the margin part by 0.5 mm each time.

As the margin part on the front side of the paper transport direction narrows, winding around the fixing belt is likely to occur, and thus the evaluation of the releasability is performed based on the width (mm) of the margin part when the winding around the fixing belt at the time of fixing the solid image is confirmed, with reference to the following criteria. The allowable range is equal to or greater than G2. The results are indicated in Table 1.

Evaluation Criteria

G1: Width of margin part is 2 mm or less

G2: Width of margin part is greater than 2 mm and 3 mm or less

G3: Width of margin part is greater than 3 mm

TABLE 1

| | Toner | Melting temperature A of crystalline polyester resin [° C.] | Melting temperature B of paraffin wax [° C.] | Difference in melting temperature A-B [° C.] | Volume average particle diameter [nm] | Shape factor SF1 |
|---|---|---|---|---|---|---|
| Example 1 | (1) | 71 | 73 | 2 | 6.9 | 145 |
| Example 2 | (2) | 71 | 73 | 2 | 6.8 | 147 |
| Example 3 | (3) | 71 | 73 | 2 | 7.0 | 149 |
| Example 4 | (4) | 71 | 73 | 2 | 7.3 | 151 |
| Comparative Example 1 | (1C) | 71 | 77 | 6 | 7.0 | 146 |

| | | Evaluation | | | |
|---|---|---|---|---|---|
| | | | | Releasability | |
| | Toluene-insoluble portion [% by weight] | Heating condition: Number of heating rollers | Fix-ability Result | Re-sult | Margin part [mm] |
| Example 1 | 25 | 3 | G1 | G1 | 1.5 |
| Example 2 | 31 | 3 | G1 | G1 | 1 |
| Example 3 | 38 | 3 | G1 | G1 | 1 |
| Example 4 | 45 | 3 | G1 | G1 | 1 |
| Comparative Example 1 | 20 | 1 | G3 | G3 | 3.5 |

From the above results, in Examples, it is understood that the fixability is excellent as compared with Comparative Example.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holding member;

a charging unit configured to charge a surface of the image holding member;

an electrostatic charge image forming unit configured to form an electrostatic charge image on a charged surface of the image holding member;

a developing unit that includes an electrostatic charge image developer containing an electrostatic charge image developing toner, the developing unit being configured to develop the electrostatic charge image on the surface of the image holding member to thereby form a toner image;

a transfer unit configured to transfer the toner image to a recording medium; and a fixing unit configured to fix the toner image on the recording medium, wherein the fixing unit includes:

a fixing belt, a pressurizing rotator that forms a nip portion between the fixing belt and the pressurizing rotator by pressurizing an outer peripheral surface of the fixing belt, a first heating rotator that is provided so as to contact an inner peripheral surface of the fixing belt in the nip portion, the first heating rotator being configured to heat the fixing belt, and a second heating unit that is provided on at least one of an inner peripheral surface side and an outer peripheral surface side of the fixing belt, the second heating unit being configured to heat the fixing belt separately from the first heating rotator, and wherein the electrostatic charge image developing toner includes:

a binder resin containing an amorphous resin and a crystalline resin; and paraffin wax, wherein the toner has a volume average particle diameter of 6 μm to 9 μm, a shape factor SF1 of 140 or more, and a toluene-insoluble portion of greater than 30% by weight and not greater than 35% by weight;

the paraffin wax has a melting temperature of 60° C. to 80° C.; and an absolute value of a difference between a melting temperature of the crystalline resin and a melting temperature of the paraffin wax is 10° C. or less.

2. The image forming apparatus according to claim 1, wherein the melting temperature of the paraffin wax is from 65° C. to 78° C.

3. The image forming apparatus according to claim 1, wherein the melting temperature of the paraffin wax is from 65° C. to 75° C.

4. The image forming apparatus according to claim 1, wherein the absolute value of a difference between the melting temperature of the crystalline resin and the melting temperature of the paraffin wax is 5° C. or less.

5. The image forming apparatus according to claim 1, wherein the crystalline resin is a polyester resin.

6. The image forming apparatus according to claim 1, wherein a content of the crystalline resin is from 3% by weight to 20% by weight with respect to the toner.

7. The image forming apparatus according to claim 1, wherein a content of the crystalline resin is from 5% by weight to 15% by weight with respect to the toner.

8. The image forming apparatus according to claim 1, wherein an area to be heated, in which the fixing belt is heated by the second heating unit, is an area on a downstream side of the nip portion in a rotation direction of the fixing belt, and is within 50% of a circumferential length of the fixing belt from the nip portion.

9. The image forming apparatus according to claim 1, wherein a molecular weight distribution Mw/Mn of the amorphous resin is from 1.5 to 100, wherein Mw represents a weight average molecular weight of the amorphous resin, and wherein Mn represents a number average molecular weight of the amorphous resin.

10. The image forming apparatus according to claim 1, wherein a molecular weight distribution Mw/Mn of the amorphous resin is from 2 to 60, wherein Mw represents a weight average molecular weight of the amorphous resin, and wherein Mn represents a number average molecular weight of the amorphous resin.

* * * * *